US006082499A

United States Patent [19]

O'Donnell

[11] Patent Number: 6,082,499

[45] Date of Patent: Jul. 4, 2000

[54] WRAP-AROUND ELEVATOR DOOR

[75] Inventor: Timothy P. O'Donnell, Delray Beach, Fla.

[73] Assignee: Vertisys International, Inc., Boca Raton, Fla.

[21] Appl. No.: 09/129,162

[22] Filed: Aug. 5, 1998

[51] Int. Cl.[7] ..... B66B 13/06

[52] U.S. Cl. ..... 187/324; 187/334; 49/425; 160/196.1; 16/96 R; 16/87 R

[58] Field of Search ..... 187/324, 334, 187/313; 49/40, 41, 349, 425, 128, 127; 160/222, 223, DIG. 8, 196.1; 16/96 R, 87 R

[56] References Cited

U.S. PATENT DOCUMENTS

| | | | |
|---|---|---|---|
| 1,180,156 | 4/1916 | Kranebiel . | |
| 1,258,439 | 3/1918 | Ogden | 16/87 R X |
| 1,426,170 | 8/1922 | Frantz | 160/196.1 X |
| 1,555,281 | 9/1925 | Engl et al. . | |
| 1,654,857 | 7/1928 | Brady . | |
| 1,735,153 | 11/1929 | Bouton . | |
| 1,867,883 | 7/1932 | Haddlesay | 16/96 R X |
| 2,517,823 | 8/1950 | Angell | 16/96 R X |
| 2,689,003 | 9/1954 | Helbert et al. . | |
| 3,003,551 | 10/1961 | Ferris | 160/196.1 |
| 3,065,334 | 11/1962 | Hillenbrand et al. | 16/96 R X |
| 3,071,825 | 1/1963 | Ferris | 49/127 |
| 3,541,731 | 11/1970 | Rossie | 49/425 |
| 4,102,008 | 7/1978 | Janson | 16/96 R |
| 4,597,549 | 7/1986 | Ryan | 160/DIG. 8 |
| 4,635,756 | 1/1987 | Sherwood et al. . | |
| 5,016,318 | 5/1991 | Harris | 16/95 R |
| 5,036,953 | 8/1991 | Munz | 187/334 |
| 5,109,911 | 5/1992 | Bockisch . | |
| 5,143,137 | 9/1992 | West | 160/196.1 X |
| 5,373,916 | 12/1994 | Kiviniemi et al. . | |

*Primary Examiner*—Robert P. Olszewski
*Assistant Examiner*—Steven B. McAllister
*Attorney, Agent, or Firm*—Brooks & Kushman P.C.

[57] ABSTRACT

A flexible door assembly includes an upper guide track comprising an elongate bar including at least two generally planar support surfaces. The upper guide track is mounted in the elevator cab, or outside the cab in the hoistway, above the door opening, defining a non-linear pathway. A plurality of door sections each having a door panel, and a carriage assembly including a carriage frame and at least two wheels each supported by, and in rolling contact with, one of the at least two support surfaces on the guide track, a hinge pin supported by the carriage, a door panel pivotally connected to the hinge pin, and wherein the carriage, the hinge pin, and the door panel pivot about the same vertical axis defined by the longitudinal axis of the hinge pin when a door assembly has moved through a bend in the upper guide track.

7 Claims, 11 Drawing Sheets

WRAP-AROUND ELEVATOR DOOR

TECHNICAL FIELD

The present invention relates to a flexible elevator door which may be moved in a non-linear path as the elevator door is opened and closed.

BACKGROUND ART

Conventional elevator designs typically include a box-like elevator cab mounted within a hoistway and including one or more sets of doors including large solid door panels that are moved from the opened to closed position and back on a linear pathway. However, variations of the conventional commercial elevator design, such as smaller limited-usage, limited-access elevators which are increasingly being installed or retrofitted in homes or small apartment buildings, and cylindrically shaped elevators, require door assemblies in which the doors open and close in a non-linear pathway to facilitate operation of the doors within the smaller space and/or to allow the doors to move in conformance with the cylindrical shape of the elevator cab.

U.S. Pat. No. 5,036,953, issued to William E. Munz on Aug. 6, 1991, discloses a retractable elevator door including a plurality of door panel assemblies which are interconnected and move through a right-angle bend along upper and lower tracks to provide an elevator door that does not require a lot of space outside of the elevator cab for receipt of the door panels when the door is opened. Munz, however, utilizes a wheel assembly and guide track design which is relatively complex and expensive to manufacture. Moreover, the interlocking panel assemblies similarly require interconnection of many parts. The panel assemblies which utilize a plurality of generally rectangular panels with generally cylindrical hinge pins in between the panels, provide a door surface which has a lot of openings running for the entire length of the door.

SUMMARY OF THE INVENTION

It is therefore an object of the present invention to provide an improved wrap-around elevator door that does not require a lot of space outside the elevator cab for receipt of the door panels when the elevator doors are open.

It is another object of the present invention to provide a flexible elevator door that may be moved in a generally arcuate pathway so that the elevator doors wrap-around (i.e., conform to) the generally arcuate exterior of a cylindrical shaped elevator cab.

It is yet another object of the present invention to provide a flexible elevator door including a plurality of interconnected door panel assemblies which limit the number of spaces, and amount of space between the assemblies to seal the interior of the elevator from outside light, as well as to minimize the opportunity for a passenger to pinch his/her hands or catch clothing in the moving door.

It is yet another object of the present invention to provide a wrap-around elevator door including an improved carriage assembly and guide track which is easier to manufacture and more reliable in day-to-day operation.

It is yet another object of the present invention to provide a wrap-around elevator door including an improved carriage assembly in which the guide wheels continuously maintain contact with the support surfaces of the guide track as the carriage moves over a curved portion of the track.

In accordance with these and other objects of the present invention, a flexible door assembly is provided which includes an upper guide track comprising an elongate bar including at least two generally planar support surfaces. The upper guide track is mounted in the elevator cab, or outside the cab in the hoistway, above the door opening and defines a non-linear pathway. A plurality of door sections each having a door panel, and a carriage assembly including a carriage frame and at least two wheels each supported by, and in rolling contact with, at least two of the support surfaces on the guide track and a hinge pin extending from the carriage frame to pivotally connect the carriage assembly to the door panel.

The door sections each include an elongate panel which extends for substantially the entire length of the door. The panel includes a carriage connector, preferably in the form of a connector bar which is secured to the top surface of the panel and includes a threaded aperture suitable to connect to the hinge pin which is mounted on the carriage, thereby pivotally connecting the panel to the carriage so that both the carriage and the panel pivot relative to the longitudinal axis of the hinge pin as the carriage moves along the non-linear upper guide track. The panel also includes a pin receptacle located at the top of the panel on the side opposite the carriage connector. The opening in the connector bar through which the hinge pin extends and is attached, also preferably extends past the edge of the panel and over the pin receptacle in the adjacent panel so that it may receive the hinge pin from the carriage associated with the adjacent panel section, thereby interconnecting the adjacent panels and allowing for pivotal movement of each of the panels and the interconnected carriage about the hinge pin axis.

The upper guide track is preferably shaped to include two upper, angled, generally planar support surfaces. Each support surface preferably supports one of two wheels which are mounted on the carriage frame for rolling contact on the upper support surface, and which allow the carriage frame to extend around the sides and bottom surface of the upper guide track. The upper guide track also preferably includes a pair of lower generally planar guide surfaces so that the upper guide track is generally diamond shaped in cross-section. The carriage frame is preferably shaped to include wheel support arms including generally planar surfaces which are suitably angled to be parallel to the lower guide surfaces to limit any movement or rocking of the carriage in the direction transverse to the pathway defined by the guide track.

The carriage also preferably includes an additional bearing surface, preferably in the form of an upthrust roller, which is mounted for rotation within the carriage frame for contacting a lower surface of the guide track generally opposite the generally flat support surfaces supporting the wheels, thereby minimizing unwanted rotation and/or movement of the carriage frame in an upward direction.

Each of the panels preferably include a first vertical edge shaped generally as the convex outer surface of a cylinder, and a second, opposite vertical edge shaped as a similar, but concave, cylindrical portion. When interconnected, the generally convex cylindrical edge at one panel is partially surrounded by the generally concave edge of the adjacent panel.

Each of the door sections also preferably includes a bottom connector bar to which one or more downwardly extending hinge pins may be mounted. A roller bearing is preferably attached to the bottom of each hinge pin, positioned in a trackway defined in a lower guide track to provide an additional guideway for the door assembly.

These and other objects, features, and advantages of the present invention are readily apparent from the following detailed description of the best mode for carrying out the invention when taken in connection with the accompanying drawings.

BEST MODES OF CARRYING OUT THE INVENTION

Figure 1:
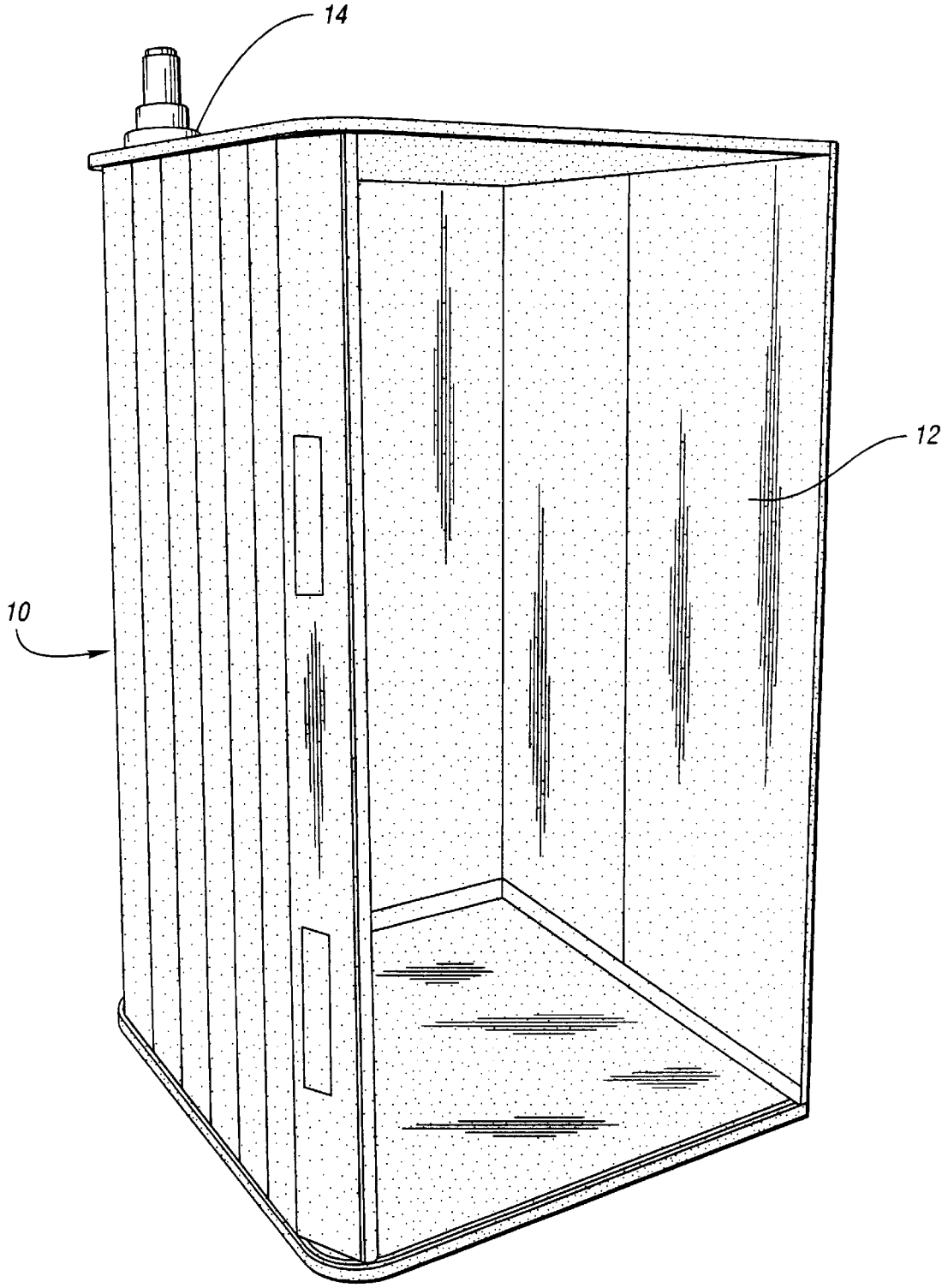
FIG. 1 is a perspective view of an elevator cab including a wrap-around door assembly of the present invention.

Referring now to the drawings, FIG. 1 illustrates one embodiment of the wrap-around elevator door 10 installed on a conventionally-shaped elevator cab 12. In this embodiment the door 10 of the present invention is connected to an automatic door operator 14. It will, of course, be appreciated by those skilled in the art that the present invention may be utilized with any of a variety of known automatic door operators or, alternatively, may be installed in an elevator, or in a hoistway, for manual operation.

Figure 2:
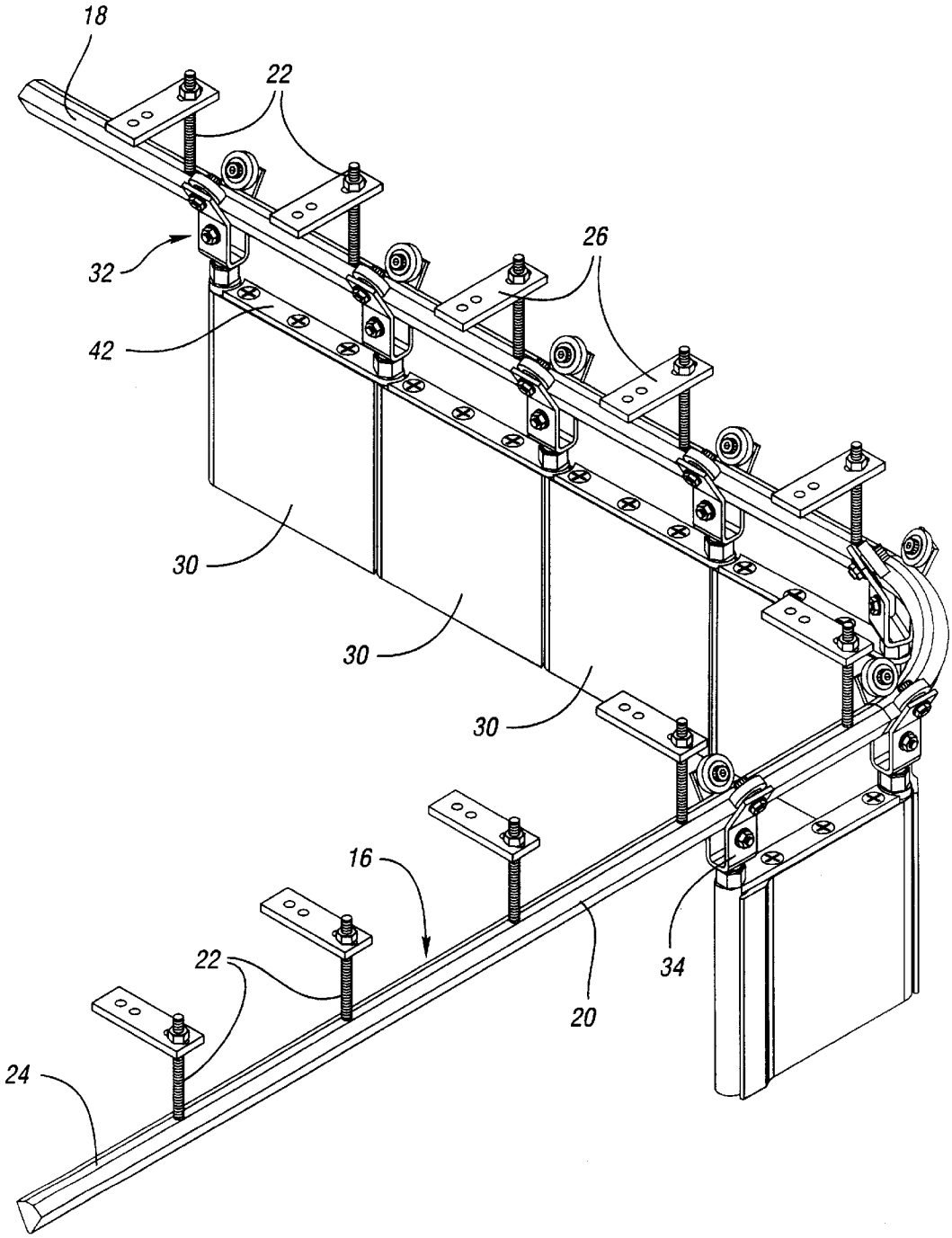
FIG. 2 is an isolated perspective view of one embodiment of the door assembly which may be utilized with elevators of the type shown in FIG. 1.
Figure 3:
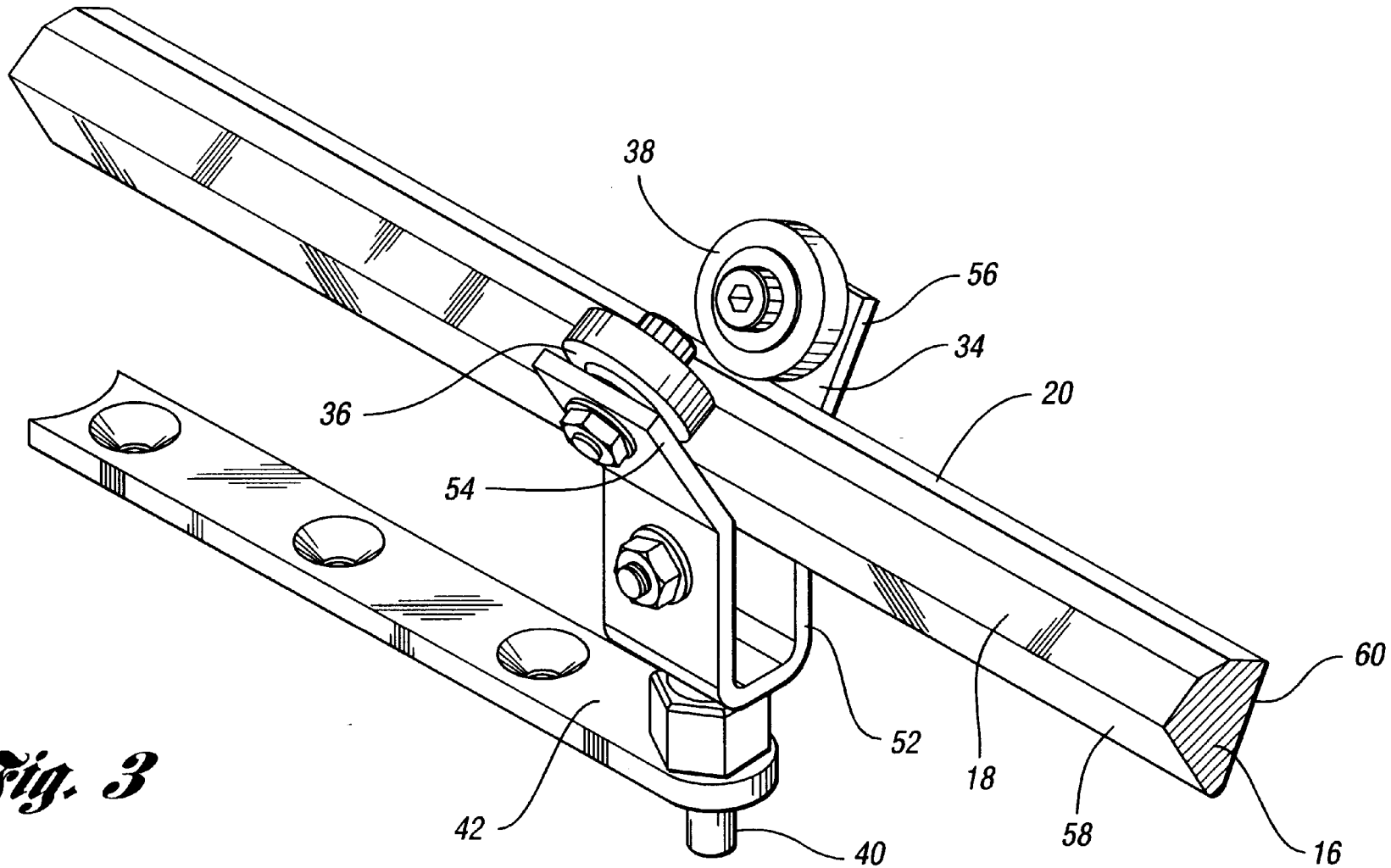
FIG. 3 is a partial perspective view of a carriage and the upper guide track.
Figure 4:
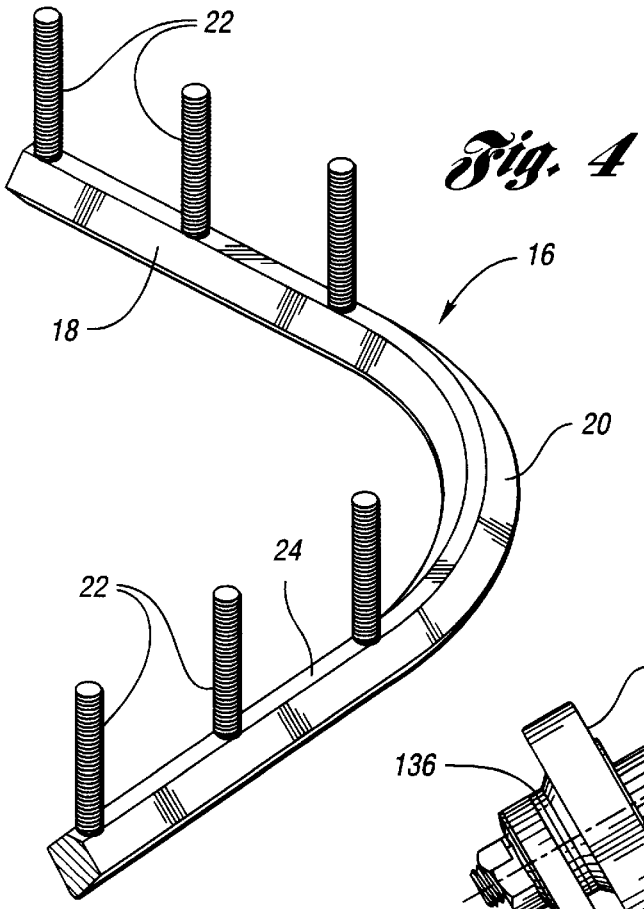
FIG. 4 is an isolated view of one embodiment of the upper guide track which may be employed with the present invention.

As illustrated in FIGS. 2–4, the elevator door 10 includes an upper guide track 16 comprising an elongate bar including at least two generally planar support surfaces 18,20. The upper guide track is suspended from the elevator cab (or from the wall to the hoistway when the door is installed as a hoistway door) in a suitable position to define the desired door opening and closing pathway. The upper guide track 16 is preferably suspended by connecting a plurality of threaded rods 22 to the top center surface 24 using a plurality of brackets 26 which are, in turn, permanently secured to the elevator cab (or, secured to the hoistway walls for a hoistway door).

The upper guide track is fabricated from a strong lightweight material. In the illustrated embodiment, the upper support track is an extruded aluminum alloy, which is suspended from the elevator car (or from within the hoistway for hoistway door applications) by a plurality of commercially available threaded steel rods 22. It will be appreciated that other similarly strong and lightweight material, such as high impact plastics, may be utilized for the upper guide track.

A plurality of door sections 28 are mounted on the upper guide track 16 and interconnected as hereinafter further described to provide a flexible, wrap-around door which may be moved in any desired non-linear path from a closed to open position (and vice versa) on an elevator cab or hoistway. Each door section 28 includes a door panel 30 and a carriage assembly 32. The carriage assembly includes a carriage frame 34 and at least two wheels mounted thereon for rolling contact with the top support surfaces 18,20 on the upper guide track 16. The carriage assembly 32 further includes a hinge pin 40 which pivotally connects the carriage frame 34 to the door panel 30 so that the door panel 30 pivots relative to the carriage assembly 32 about the longitudinal axis of the hinge pin 40 as the door section moves along curved portions of the upper guide track 16.

The door panel 30 is an elongate panel which preferably extends generally vertically from the hinge pin 40 for substantially the entire length of the door opening. The panel is preferably made of a strong lightweight material, most preferably extruded aluminum. The panel includes a carriage connector, preferably in the form of a connector bar 42 which is secured to the top surface of the door panel and includes a threaded aperture 44 suitable to accommodate the hinge pin which is mounted on, and extends downwardly from the carriage frame 34, to thereby pivotally connect the panel 30 to the carriage frame 34. The door panel 30 also includes a pin receptacle 46 located on the top surface of the panel 30 on the edge opposite the carriage connector.

The connector bar 42 is preferably positioned on the top surface of the door panel 30 so that the aperture on the support bar is located outboard of one of the vertical edges of the door 30, so that when the hinge pin is attached to the connector bar 42 it extends downward underneath the connector bar adjacent the vertical edge of the door panel. During installation, the lower portion 50 of the hinge pin is preferably inserted into the pin receptacle 46 of the door panel on an adjacent door section 28, thereby interconnecting the adjacent panels and allowing for pivotal movement of the adjacent door panel 31 relative to hinge pin 40 as the adjacent door sections 28,29 are moved along the upper guide track 16.

As previously described, the upper guide track 16 preferably includes two generally upwardly facing top support surfaces 18 and 20. The top support surfaces 18 and 20 are generally planar surfaces which, when the upper guide track is suspended as shown in FIG. 2 orient each of the surfaces 18 and 20 at a slight angle from horizontal.

Figure 5:
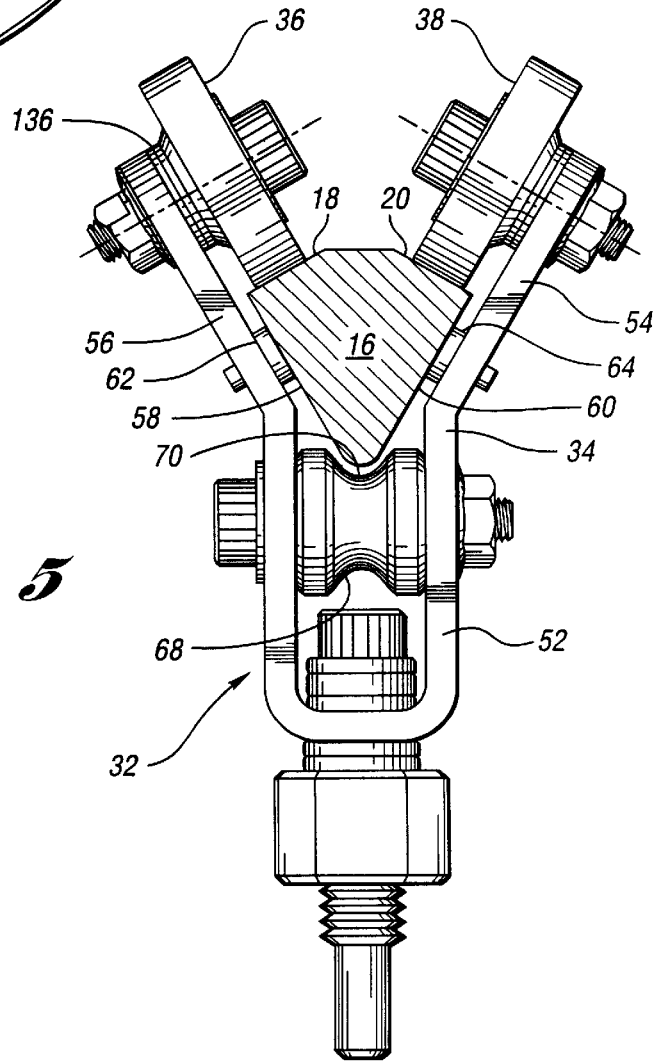
FIG. 5 is an end view of the carriage/guide track assembly.

As illustrated in FIG. 5, the carriage frame 34 is preferably shaped to include a U-shaped base 52 and a pair of wheel support arms extending upward from the base 52 in a generally flared orientation to provide a mounting surface for each of the wheels 36 and 38 which is generally orthogonal to the plane of the top support surfaces 18,20 of the upper guide track 16. When the wheels 36 and 38 are mounted on the carriage frame arms 54 and 56 using conventional fasteners, the carriage assembly 32 may be slidably mounted on the upper guide track 16 so that the wheels are above the upper guide track in rolling contact with the angled top support surfaces 18 and 20 of the upper guide track. It has been found that the angled surfaces provide a more stable support for the door section 28 as the interconnected door sections are suspended from and move around curves in the pathway defined by the upper guide track 16. The angle of the top support surfaces is preferably about 15 degrees to 60 degrees, and most preferably about 30 degrees, from horizontal. When the door section is moved about a curved portion of the track, the wheels 36,38 tend to maintain continuous contact with the top support surfaces 18 and 20 of the upper guide track 16 to provide a smoother, more stable interaction of the carriage assembly 32 with the upper guide track 16 as the door is supported for movement along the non-linear pathway.

The upper guide track 16 also preferably includes a pair of lower, generally planar bearing surfaces 58 and 60, each of which is generally orthogonal to the adjacent top support surfaces 18 and 20, so that the upper guide track 16 is generally diamond-shape in cross-section. The wheel mounting arms 54 and 56 are preferably flared from the base portion 52 of the carriage frame 34 so that the inside surface of each of the arms 54 and 56 are parallel, respectively, to each of the lower bearing surfaces 60 and 58. Bearing buttons 62 and 64 may also be mounted on the inside surface of each of the arms 54 and 56 of the carriage frame 34 so that the contact surfaces of the wheels 36 and 38 and the bearing surfaces 62 and 64 conform to the shape of the upper guide track 16 for a smooth, continuous contact with the guide track during operation.

An upthrust roller 66 is preferably mounted, using conventional fasteners, to extend across the opening in the U-shaped base 52 of the carriage frame 34 so that the bearing surface 68 of the upthrust roller may contact the bottom surface of the upper guide track as the carriage assembly 32 is moved along the guide track. In addition to stabilizing the carriage assembly on the guide track 16, the upthrust roller 66 provides a structural support for the carriage frame 34, thereby insuring that the frame maintains its shape, and consequently, that the arm portions 54 and 56 of the frame maintain their proper orientation with respect to the top support surfaces 18 and 20 and lower bearing surfaces 58 and 60 of the guide track for more reliable continued operation of the assembly. The upthrust roller 68 is typically fabricated from a resilient material, such as nylon, as is connected to the carriage frame 34 using conventional fasteners, such as a nut, bolt and washer, as illustrated in FIG. 5.

The wheels 36 and 38 are also preferably fabricated from nylon, although other similarly resilient materials may be utilized. These wheels are preferably fastened to the carriage frame using conventional fasteners such as the nut, bolt and washer shown in FIG. 5.

The carriage frame is preferably fabricated from steel, or other material similarly suitable for this purpose.

The bearing buttons 60,62 are preferably nylon tab, available as part number 90136A465 from McMaster & Karr of Atlanta, Ga.

Figure 6:
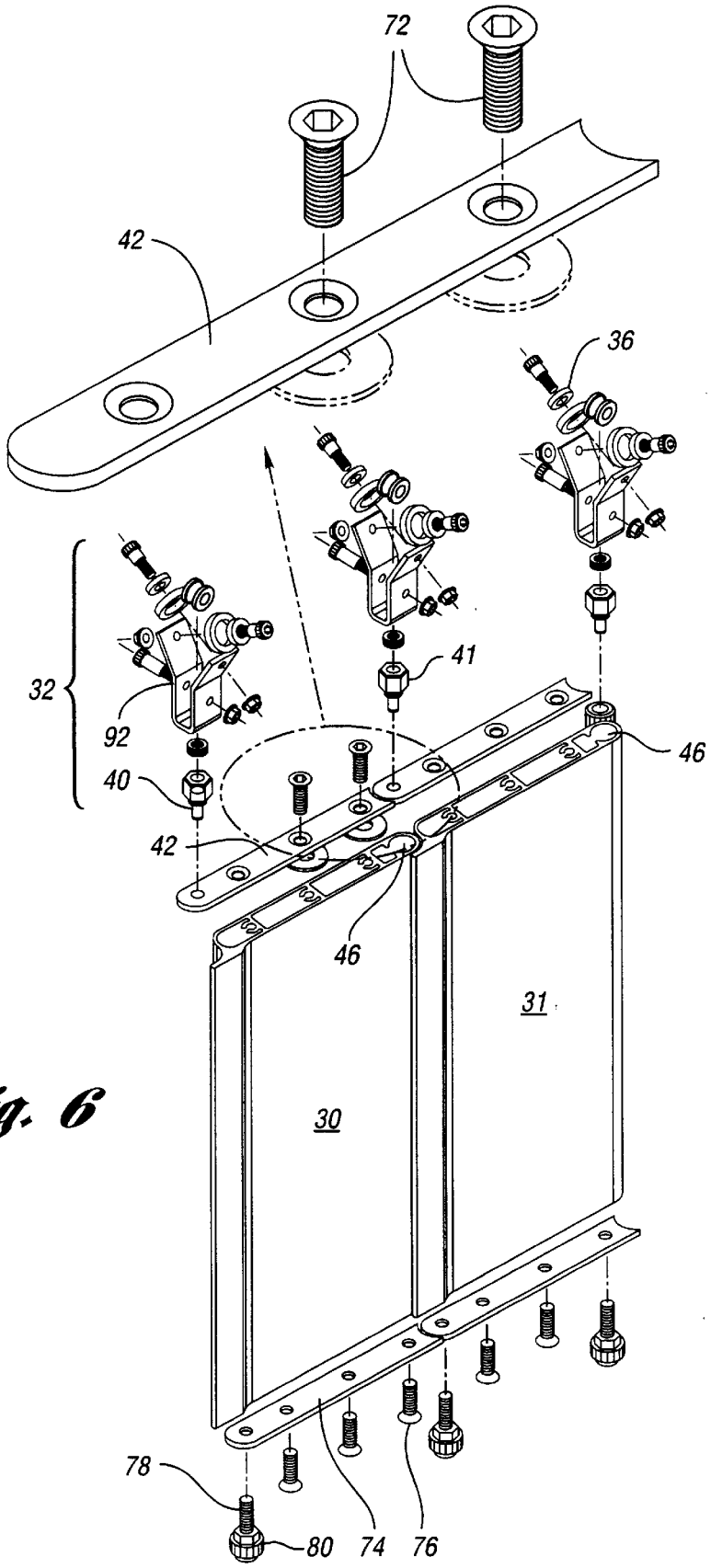
FIG. 6 is a partially exploded view of two of the door sections of the door assembly of FIG. 2.

FIG. 6 illustrates an exploded view of two adjacent door sections 28. Each door section 28 includes a door panel 30 and a carriage assembly 32, as described in detail above. In this embodiment the carriage assembly is attached to the door panel 30 by threadably securing the hinge pin 40 through the aperture 44 in a connector bar 42. The connector bar 42 is secured to the top of the door panel via a plurality of conventional threaded fasteners 72. In this embodiment, a lower bar 74 is also attached, at the bottom surface of the door panel 30 via a plurality of conventional threaded fasteners 76, and a bottom hinge pin 78 is threadably connected to the lower bracket 74. A resilient bearing 80 is also preferably attached to the bottom hinge pin 78.

Figure 7:
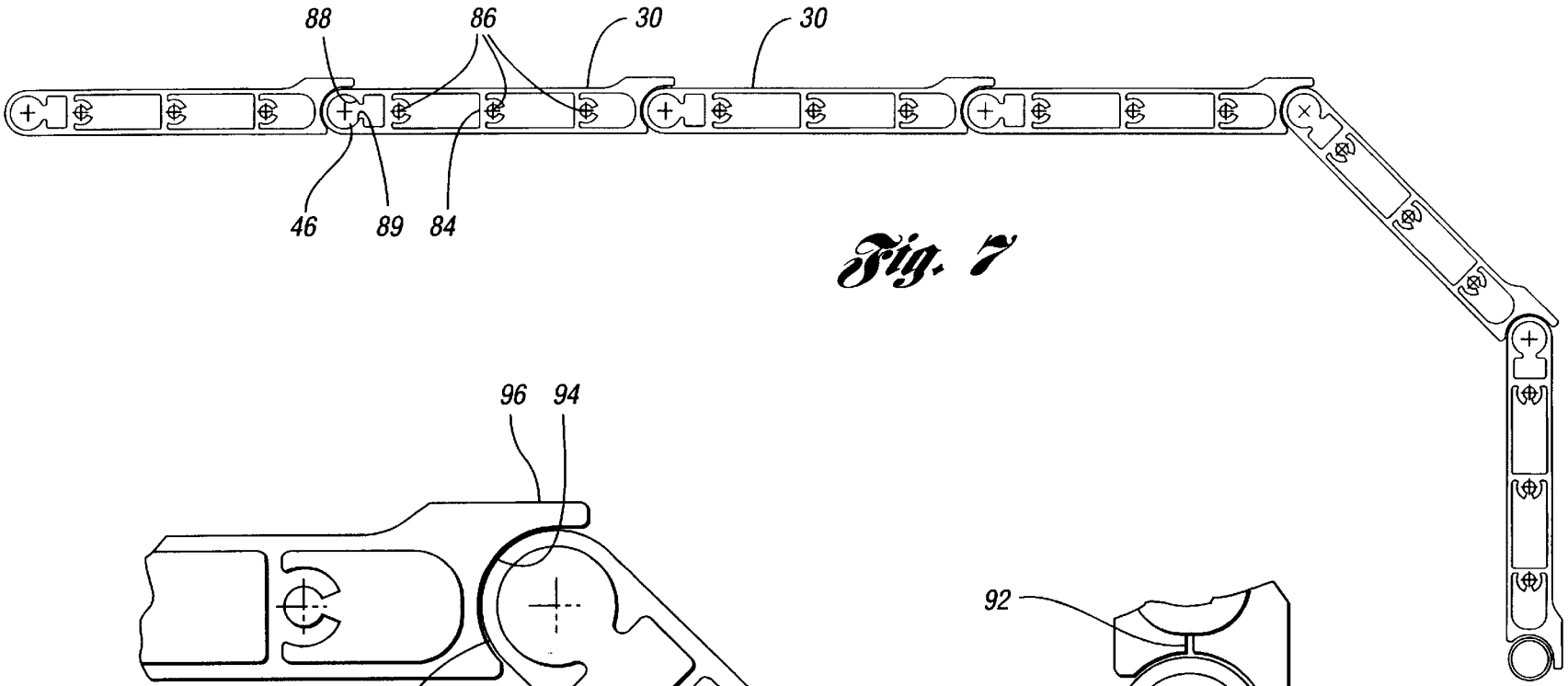
FIG. 7 is a partial top view in cross-section of a plurality of the door panels in the door assembly.

With continuing reference to FIG. 6, the aperture 44 on the connector bar 42 is located outboard of the vertical edge of the panel 30, so that the hinge pin 40 extends downward, generally parallel to, and outside the edge of the panel. When this door section 28 and an adjacent door section are installed on the upper guide track 16, the hinge pin is inserted into a hinge pin receptacle 46 in the top of the door section 30 adjacent the edge opposite the edge of the door section to which the carriage assembly is attached. Thus, as illustrated in FIG. 7 the door section pivots about the axis of hinge pin 40 of the carriage assembly 32 to which the door panel 30 is secured, and also pivots about the hinge pin 41 extending from the carriage assembly 33 which is attached to the adjacent door panel 31 as the door sections are carried on the non-linear pathway defined by the upper guide track 16.

Referring now to FIGS. 6, 7, 8 and 9, the door panels 30 are preferably fabricated from a strong lightweight material, preferably extruded aluminum, although other plastic or composite materials may be suitable for the panels. In the illustrated embodiment, each panel is a substantially hollow frame 82 which surrounds a plurality of inner walls 84. In the illustrated embodiment the door panel 30 is extruded from an aluminum alloy, preferably alloy #6263, to provide inner walls 84 which run the entire length of the panel. Apertures 86 are defined in the inner walls during the extrusion process. These apertures are suitably sized to accept conventional threaded fasteners, so that the connector bar 42 and lower bar 74 can each be connected to the top and bottom surfaces, respectively, of the panel. Inner walls 88,89, which also preferably run the entire length of the panel 30 along with the outer frame 82 define the pin receptacle 46 which is preferably located at one edge of the door panel.

One edge of the door panel is preferably shaped as a convex cylindrical portion 90, while the opposite edge of each door panel has a generally concave cylindrical surface 94 defined on the other side of this edge of the door panel 30. When installed, the generally convex end of one panel is immediately adjacent the generally concave edge 94 of an adjacent panel so that the extended portion 96 of one panel covers the space between the adjacent panels. These edge configurations provide for a close fit and smooth mating surfaces between adjacent panels. Moreover, the extended portion 96 of the panel edge having the convex surface 94 further seals off the elevator cab from outside light, as well as shielding the adjacent edges of the pivoting door panels during movement of the door, thereby eliminating the possibility of clothing or extremities getting caught in between the panels as they pivot about a non-linear path during opening or closing of the door.

It will be appreciated that these panels can be extruded to relatively uniform and precise size which ensures a close fit and smooth operation of adjacent door sections 28. Moreover, the extruded aluminum panels of the illustrated embodiment are substantially lighter than prior steel panel doors, yet still provide more than adequate strength.

Figure 9:
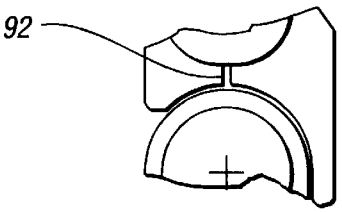
FIG. 9 illustrates two adjacent panels with a bearing button therebetween.
Figure 8:
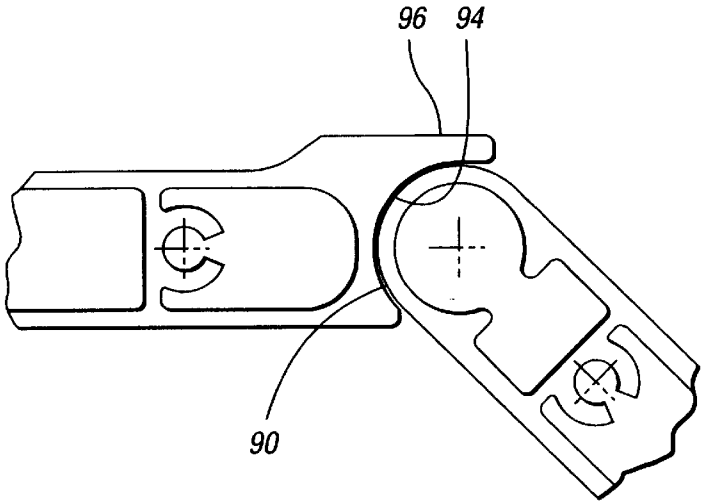
FIG. 8 is a top partial cross-sectional view of two adjacent wall panels.

As illustrated in FIG. 9, one or more bearing buttons 92 may be mounted on the concave cylindrical surface 94 at selected locations over the length of the panel to provide a wearable bearing surface. The bearing buttons may be of any resilient, low friction material, such as nylon. In the illustrated embodiment nylon tabs are used, and include a shank portion which may be snap-fit into suitably located holes drilled into the concave cylindrical surface 94 of the panel.

Figure 10:
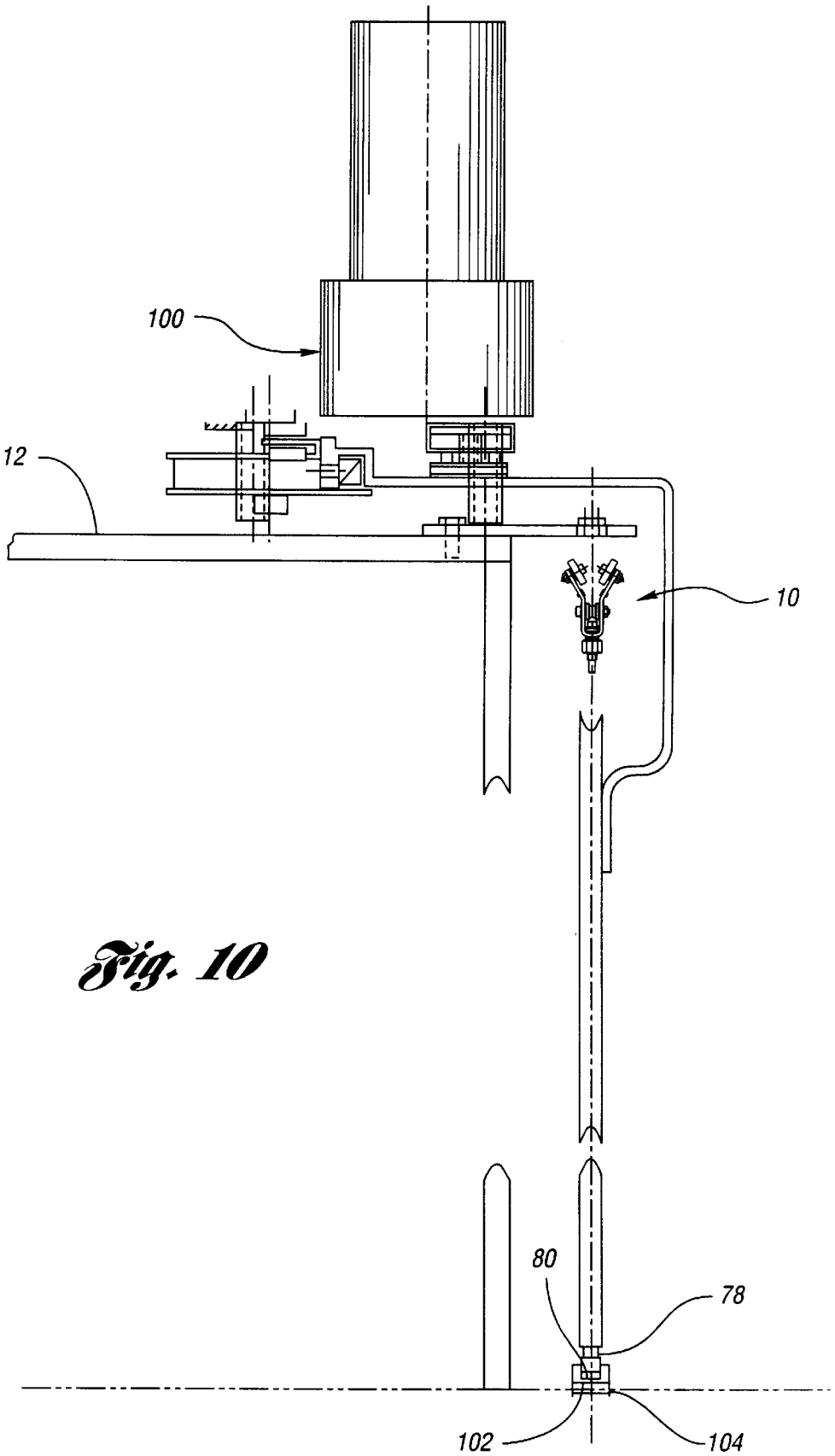
FIG. 10 is a partial side view in cross-section of an elevator cab with the wrap-around door assembly mounted thereon.

FIG. 10 illustrates the wrap-around door of the present invention installed in an elevator 12. In this embodiment, the door is automatically driven via a door operator of the type illustrated in Applicant's co-pending U.S. patent application Ser. No. 08/726,780, filed Oct. 7, 1996, (the disclosure of which is incorporated herein in its entirety) which is suitably modified for this purpose. Of course, other commercially available drive systems may alternatively be employed. And, as previously described, the present invention may be installed without an automatic operator, and with suitably placed handles, for manual operation. The lower hinge pin 78 and bearing 80 are positioned to ride in a slot 102 in a lower guide track 104. Lower guide track 104 (shown in FIGS. 10 and 11) is mounted adjacent the outer front and side walls of the elevator cab. Thus, the upper and lower guide tracks each of which are shaped to define the desired door travel path (i.e., straight across the opening at the front of the elevator cab, a 90° turn at one corner 106 of the cab, and thence in a straight line along one side 108 of the cab) provide a pathway which the door sections travel on to move from a closed, generally planar position covering the entry opening of the cab 110 around a corner of the cab 106 to a generally planar open position along the sidewall 108 of the cab. Thus, in the illustrated embodiment, the wrap-around door is automatically moved to wrap around from a closed to an open position and vice versa, thereby requiring substantially less space in the hoistway than conventional elevator doors.

Figure 11:
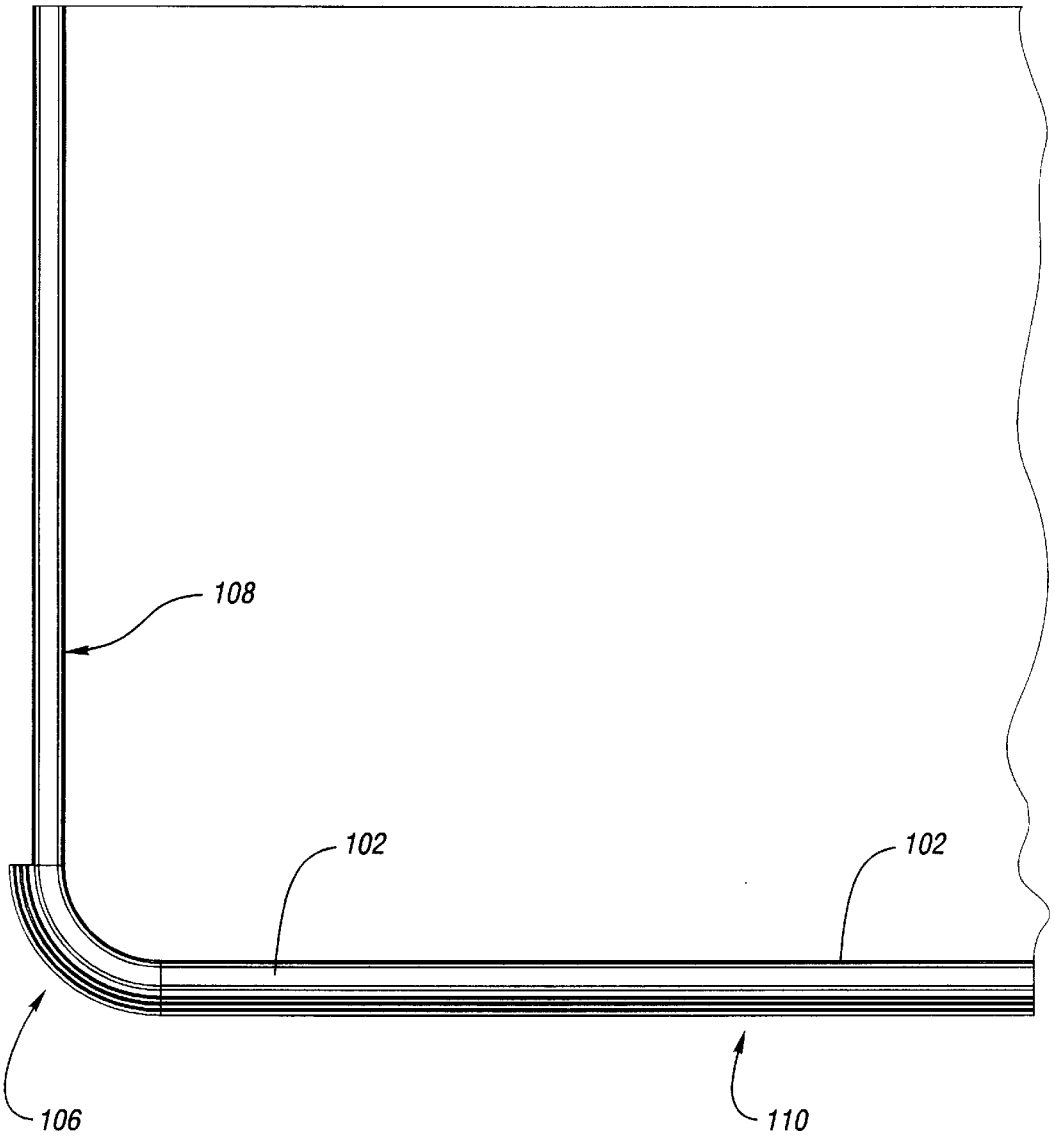
FIG. 11 is a top view of the elevator in cross-section illustrating a lower track which may be employed in the present intention.
Figure 12:
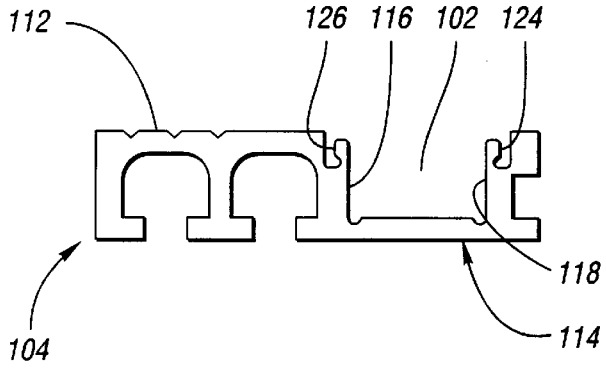
FIG. 12 is a side cross-sectional view of the bottom track.
Figure 13:
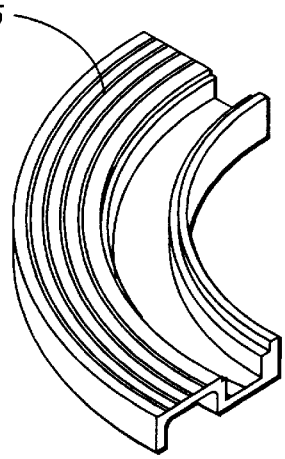
FIG. 13 is a partial perspective side view of a curved portion of the bottom track.
Figure 14:
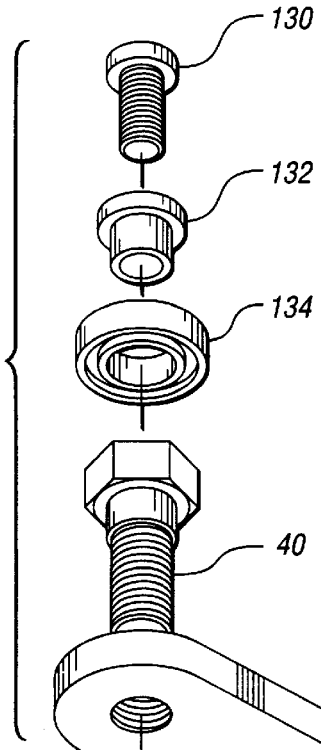
FIG. 14 is a side view of a wear strip which may be employed in the lower track in the present invention.
Figure 14:
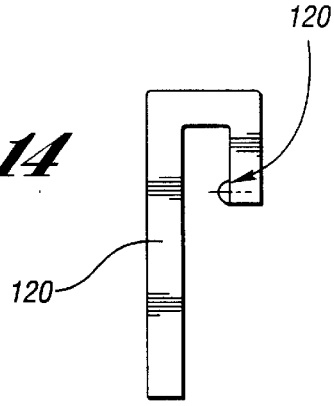

FIGS. 12–14 illustrate further details of the lower guide track 104 illustrated in FIG. 11. The lower guide track 104 is fabricated, preferably from a resilient plastic or lightweight metal, and most preferably from extruded aluminum, to provide an upper step surface 112 and a guide track 114 which receives a lower hinge pin and suitably sized bearing. The bearing preferably contacts guide surfaces 116 and 118 on the inside and outside walls of the guide track 114, thereby guiding the lower portion of the door panels 30 in each of the door sections 28 as they are moved along the pathway defined by the upper and lower guide tracks. A curve portion of the guide track, illustrated in FIG. 14 is preferably also fabricated from extruded aluminum. Again, however, it will be appreciated that the lower guide track may be fabricated from other resilient materials, such as molded plastic.

Wear strips 120, fabricated from a resilient material such as nylon, are preferably inserted into and over the contact surfaces 116 and 118 of the lower guide track to provide for a smoother operation. These wear strips are preferably molded with a securing feature which includes dimple 122, or other similarly molded in protrusion to facilitate snap-in attachment of the wear strip 120 in the lower guide track. In the illustrated embodiment dimple 122 is of suitable size to snap fit in slot 124 or 126 which is extruded into the lower guide track for this purpose.

Figure 15:
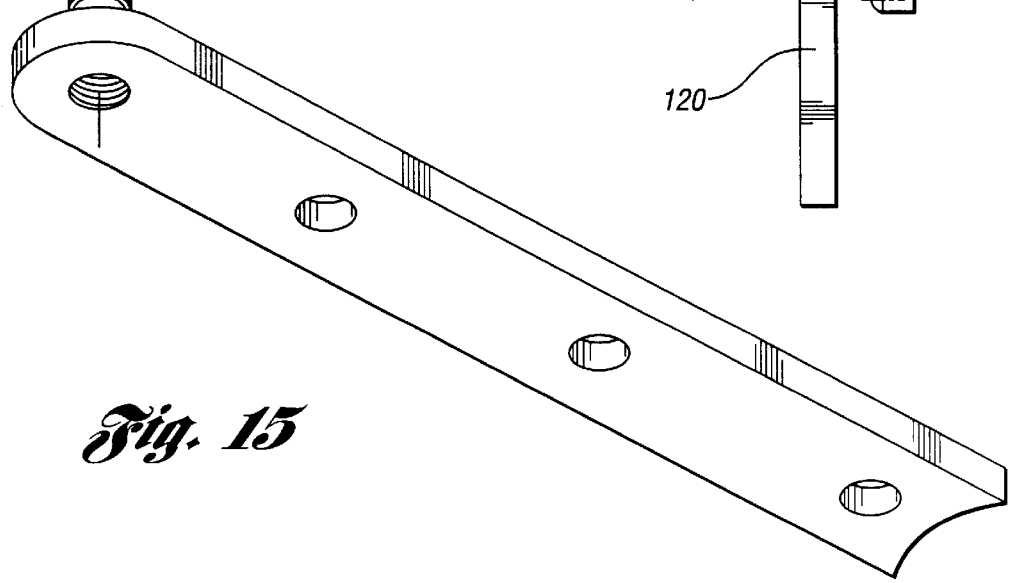
FIG. 15 is a partial perspective view of a support bar and a hinge assembly which may be employed in the present invention.

FIG. 15 illustrates the typical components which may be utilized to connect hinge pin 40 to connector bar 42. They typically include a conventional screw fastener such as shoulder bolt 130 and a bearing sleeve 132, preferably aluminum, each of which are inserted inside the bottom portion of the carriage frame (shown in FIG. 5) through a suitable aperture in the carriage frame, through a roller bearing 134 and within a threaded bore in the tope of hinge pin 40. The hinge 40 is then threadably connected to the connector bar 42 so that the bottom portion of the hinge pin 40 extends downwardly through the connector bar to serve its dual purpose of providing the interconnecting member inserted into the pin receptacle 46 of an adjacent door section 28 when the sections are installed. As with bearing 136 (FIG. 5), bearing 132 is preferably a steel roller bearing, such as are available as part No. R422 from Motion Industries of Pampano Beach, Fla.

Figure 16:
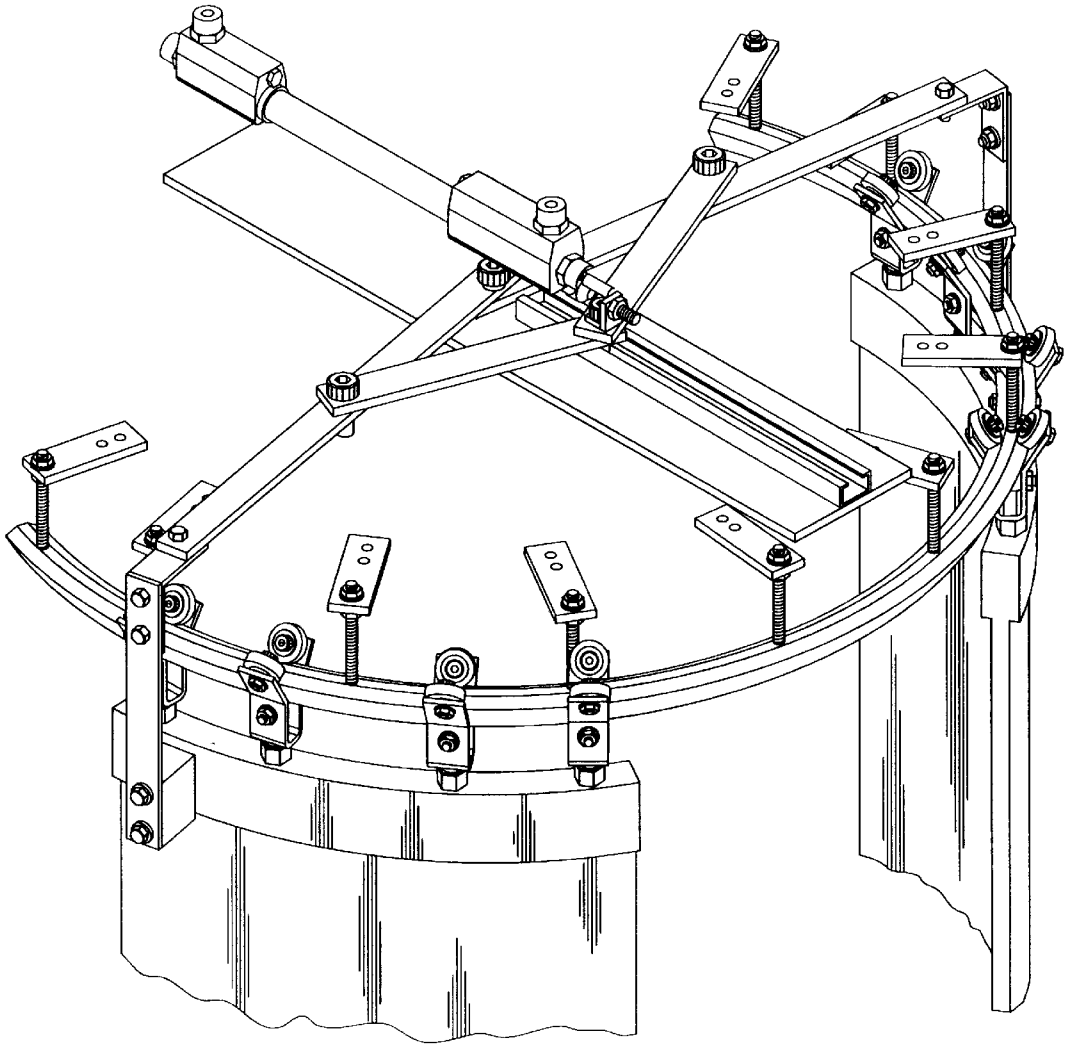
FIG. 16 is an isolated perspective view of an alterative embodiment of the present invention employed on an elevator having a cylindrical door opening.
Figure 17:
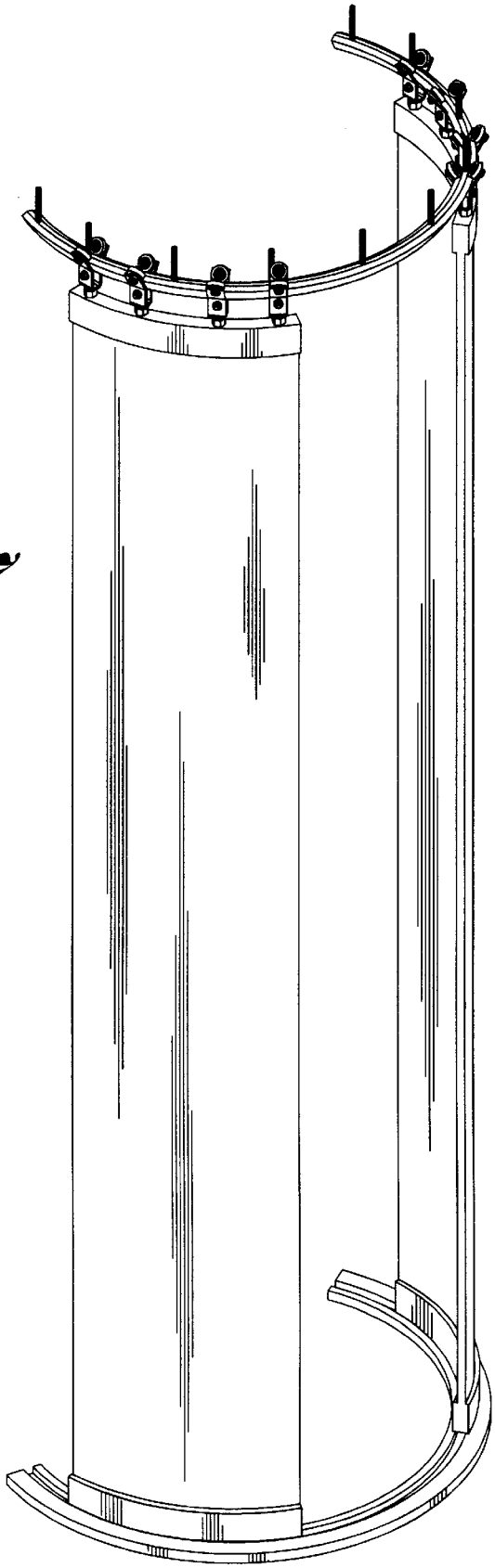
FIG. 17 is a partial perspective view of the embodiment of FIG. 16.

It will be appreciated that the wrap-around door of the present invention may be utilized in alternative embodiments which require a door for an elevator, or other enclosure, which moves in a non-linear path. For example, as illustrated in FIGS. 16 and 17, the wrap-around door of the present invention may be utilized on a cylindrically shaped elevator to provide a door which moves in a generally circular pathway. In the alternative embodiment of FIGS. 16 and 17, the carriage assemblies may be mounted atop door panels to comprise a plurality of adjacent door sections as described hereinabove. Alternatively, the same carriage assemblies and upper and lower guide tracks as described hereinabove may be utilized with solid arcuate-shaped door panels fabricated from plastic, metal, or even suitably framed and bent glass sheets. In the embodiment of FIGS. 16 and 17, the wrap-around door of the present invention may be connected to an automatic cylindrical door operator of the type disclosed in Applicant's co-pending application Ser. No. 09/129,719, entitled "Door Operator For Elevators Having Curved Doors", Attorney Docket No. VERT 0103 PUS, which application has been filed concurrently herewith, and the disclosure of which application is incorporated herein in its entirety. The wrap-around door of the present invention may be alternatively powered by other commercially available door operators, or may be installed for manual operation in this cylindrical configuration.

It will be appreciated that the wrap-around door of the present invention may be utilized with elevators or other similar enclosures to provide a lightweight reliable door which may be moved in a non-linear pathway thereby reducing the space required to accommodate the door as well as to improve the aesthetics of the elevator cab/door combination.

It will also be appreciated that, while the embodiment of FIGS. 1 and 2 illustrates a wrap-around door configured to move in one direction across the elevator cab opening, the wrap-around door of the present invention may be configured as center parting doors, or in other conventional elevator door system configurations.

While the best mode for carrying out the invention has been described in detail, those familiar with the art to which this invention relates will recognize various alternative designs and embodiments for practicing the invention as disclosed by the following claims.

What is claimed is:

1. A door assembly for an elevator cab opening wherein the elevator cab has a non-linear door pathway, the door assembly comprising:

an elongate upper guide track including at least two generally planar upper support surfaces, wherein the planes of the upper support surfaces are each at a slight angle from the horizontal plane and at least two generally planar lower guide surfaces which are angled slightly from the vertical plane so that the upper guide track is generally diamond-shaped in cross-section; and a plurality of door sections, each of the door sections including, at least one carriage assembly including a carriage frame and at least two wheels each supported by, and in rolling contact with, one of the at least two support surfaces on the guide track, the carriage frame having a generally U-shaped base and a pair of wheel support arms extending upward from the base in a generally flared orientation, wherein each of the wheel support arms provides a mounting surface for at least one of the wheels, which mounting surface is generally orthogonal to the plane of the top support surfaces of the upper guide track, and wherein the wheel support arms are generally parallel, respectively, to each of the lower bearing surfaces on the upper guide track, a hinge pin supported by said carriage, and a door panel including a carriage connector having an aperture for receiving the hinge pin for pivotal connection of the door panel to the carriage assembly, whereby the door panel and the carriage assembly pivot about the same vertical axis defined by the longitudinal axis of the hinge pin when the door section is moved through the non-linear pathway.

2. The door assembly of claim 1, further including bearing buttons mounted on the inside surface of each of the wheel support arms of the carriage frame for contact with the lower support surfaces of the upper guide track during operation.

3. The door assembly of claim 1, further including an upthrust roller mounted within the U-shaped base of the carriage frame for rollably contacting the bottom surface of the upper guide track as the carriage assembly is moved along the guide track.

4. The door assembly of claim 1, wherein each of the door panels includes a pin receptacle in the top surface of the panel at the edge of the panel opposite the edge to which the carriage assembly is pivotally attached, wherein the carriage connector is a connector bar which is secured to the top surface of the door panel, and wherein the connector bar includes a threaded aperture through which the hinge pin is threadably attached to secure the carriage assembly to the door panel, and wherein the portion of the connector bar containing the aperture extends outboard of the edge of the door panel so that when the hinge pin is threadably connected to the connector bar, the hinge pin extends downward adjacent to, and generally parallel to, the door panel.

5. The door assembly of claim 1 in one vertical edge of each of the door panels is shaped as a generally smooth convex portion of a cylinder, and where the opposite edge of each of the door panels is shaped as a generally smooth, concave cylindrical portion so that the convex edge of a door panel can be positioned within the concave edge of an adjacent panel when the panels are interconnected.

6. The door assembly of claim 5, wherein the generally concave edge of each door panel includes a generally planar extending portion which extends for substantially the entire length of the door panel thereby shielding the space between adjacent door sections.

7. The door assembly of claim 1, further including a lower guide track including a guide slot defining at least one bearing surface, wherein the lower guide track defines the identical pathway of the upper guide track, and further including a lower hinge pin secured to and extending downwardly from the bottom surface of each door panel a distance suitable to provide for positioning of the lower hinge pin within the guide slot on the lower guide track during installation of the door assembly.

* * * * *